US007226324B2

(12) United States Patent
Roos

(10) Patent No.: US 7,226,324 B2
(45) Date of Patent: Jun. 5, 2007

(54) WATERJET WITH INTERNAL DRIVE MOTOR

(75) Inventor: Paul W. Roos, Delray Beach, FL (US)

(73) Assignee: Apex Hydro Jet, LLC, Delray Beach, FL (US)

( * ) Notice: Subject to any disclaimer, the term of this patent is extended or adjusted under 35 U.S.C. 154(b) by 0 days.

(21) Appl. No.: 10/947,958

(22) Filed: Sep. 23, 2004

(65) Prior Publication Data

US 2005/0064769 A1 Mar. 24, 2005

Related U.S. Application Data

(60) Provisional application No. 60/505,064, filed on Sep. 23, 2003.

(51) Int. Cl.
*B60L 11/02* (2006.01)

(52) U.S. Cl. ..... 440/6; 440/38

(58) Field of Classification Search ..... 440/5, 440/6, 38; 114/151; 417/352–356
See application file for complete search history.

(56) References Cited

U.S. PATENT DOCUMENTS 2,714,866 A * 8/1955 Pleuger et al. ..... 440/6
2,749,874 A * 6/1956 Klatte ..... 440/5
3,464,357 A * 9/1969 Martin et al. ..... 415/193
3,970,027 A * 7/1976 Jackson ..... 114/151
4,878,864 A * 11/1989 Van Bentem ..... 440/5
5,022,987 A * 6/1991 Wells ..... 210/173
5,090,929 A 2/1992 Rieben
5,140,926 A * 8/1992 Denston ..... 114/150
5,421,753 A 6/1995 Roos
5,445,545 A 8/1995 Draper
5,490,768 A * 2/1996 Veronesi et al. ..... 417/356
6,279,499 B1 8/2001 Griffith et al.
6,655,309 B1 * 12/2003 Stephens ..... 114/144 A
6,692,318 B2 * 2/2004 McBride ..... 440/38

* cited by examiner

*Primary Examiner*—Ed Swinehart
(74) *Attorney, Agent, or Firm*—Jansson Shupe & Munger Ltd.

(57) ABSTRACT

A marine waterjet propulsion system having an impeller with an impeller hub, a diffusor with a diffusor hub, and a motor driving the impeller, the motor being placed inside at least one of said impeller and diffusor hubs. In one preferred embodiment of the propulsion system, the motor is an electric motor.

8 Claims, 3 Drawing Sheets

WATERJET WITH INTERNAL DRIVE MOTOR

RELATED APPLICATION

This application is based on U.S. Provisional Application No. 60/505,064 filed on Sep. 23, 2003, the contents of which are incorporated herein by reference.

FIELD OF THE INVENTION

This invention relates to waterjet driven-marine vehicles, and more particularly to electric waterjet propulsion systems for such marine vehicles.

BACKGROUND OF THE INVENTION

Marine waterjets have many benefits for propulsion of marine vessels, such as higher safety, higher efficiency, shallow draft and outstanding maneuverability. However, a disadvantage is the large amount of space taken up by the motor and the gearbox that are conventionally placed in front of the waterjet inside the vessel. The motor drives the waterjet by a transmission that adapts the rotational speed of the motor to that of the waterjet. A drive shaft with flexible couplings at each end, a shaft tube and a water seal connect the transmission to the impeller of the waterjet. The shaft and shaft tube pass through the waterjet intake duct, obstructing the water flow in the intake duct to the impeller, lowering the efficiency of the waterjet. U.S. Pat. No. 5,421,753 shows such a drive arrangement.

Waterjets are typically driven by internal combustion engines, which are both heavy and noisy. Also, in recent years, battery technology has developed rapidly, to the point where the stored energy densities of some batteries make electric propulsion of marine vessels a possibility. Further, advances in semiconductor switching technology enable numerous electric motor developments that would not have been possible in the past.

OBJECTS OF THE INVENTION

It is an object of this invention is to provide a marine propulsion system that is will take advantage of new battery technology and the anticipated introduction of cost-effective fuel cells as energy sources for marine propulsion systems.

It is an object of this invention in the field of marine propulsion to provide a propulsion system that is highly compact.

Still another object if this invention is to provide a marine propulsion system that is quiet.

Yet another object of this invention is to provide a marine propulsion system that is more efficient than traditional waterjets.

These and other objects of the invention will be apparent from the following descriptions and from the drawings.

SUMMARY OF THE INVENTION

The invention is a marine waterjet propulsion system having an impeller with an impeller hub, a diffusor with a diffusor hub, and a motor driving the impeller, the motor being placed inside at least one of said impeller and diffusor hubs.

In highly preferred embodiments of the invention, the motor of the inventive marine waterjet propulsion system is an electric motor. Alternately, the motor may be a hydraulic motor.

In other preferred embodiments, the marine waterjet propulsion system includes a bearing which rotatively supports the impeller with respect to the diffusor hub.

In still other preferred embodiments of the invention, the marine waterjet propulsion system further includes a transmission connecting the motor in a drive relationship with the impeller.

In yet other embodiments of the inventive waterjet system, the system includes an oil circulation pump, whereby the pump causes oil to lubricate the bearing, the motor, and the transmission.

In another embodiment of the invention, the marine waterjet propulsion system also includes an oil cooler. The pump causes oil to pass through the bearing, the motor, the transmission, and the cooler for removal of heat from the propulsion system.

In a highly preferred embodiment of the invention, the motor includes a first hollow shaft and the impeller is driven through a second hollow shaft, such first and second hollow shafts functioning as oil channels to lubricate the bearing.

DETAILED DESCRIPTION OF PREFERRED EMBODIMENTS

Figure 1:
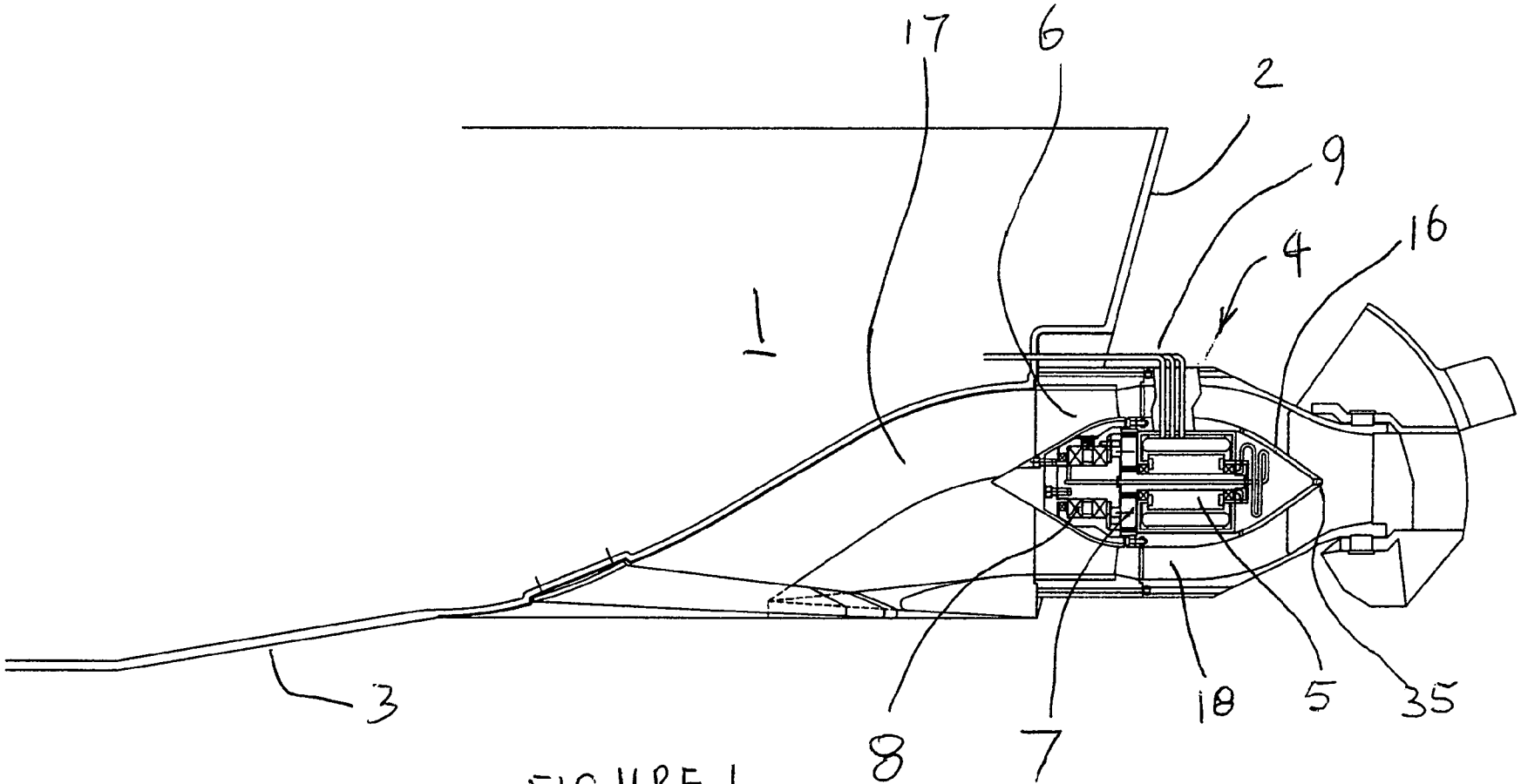
FIG. 1 is an elevation section of an electric waterjet with integrated electric motor and transmission.
Figure 2:
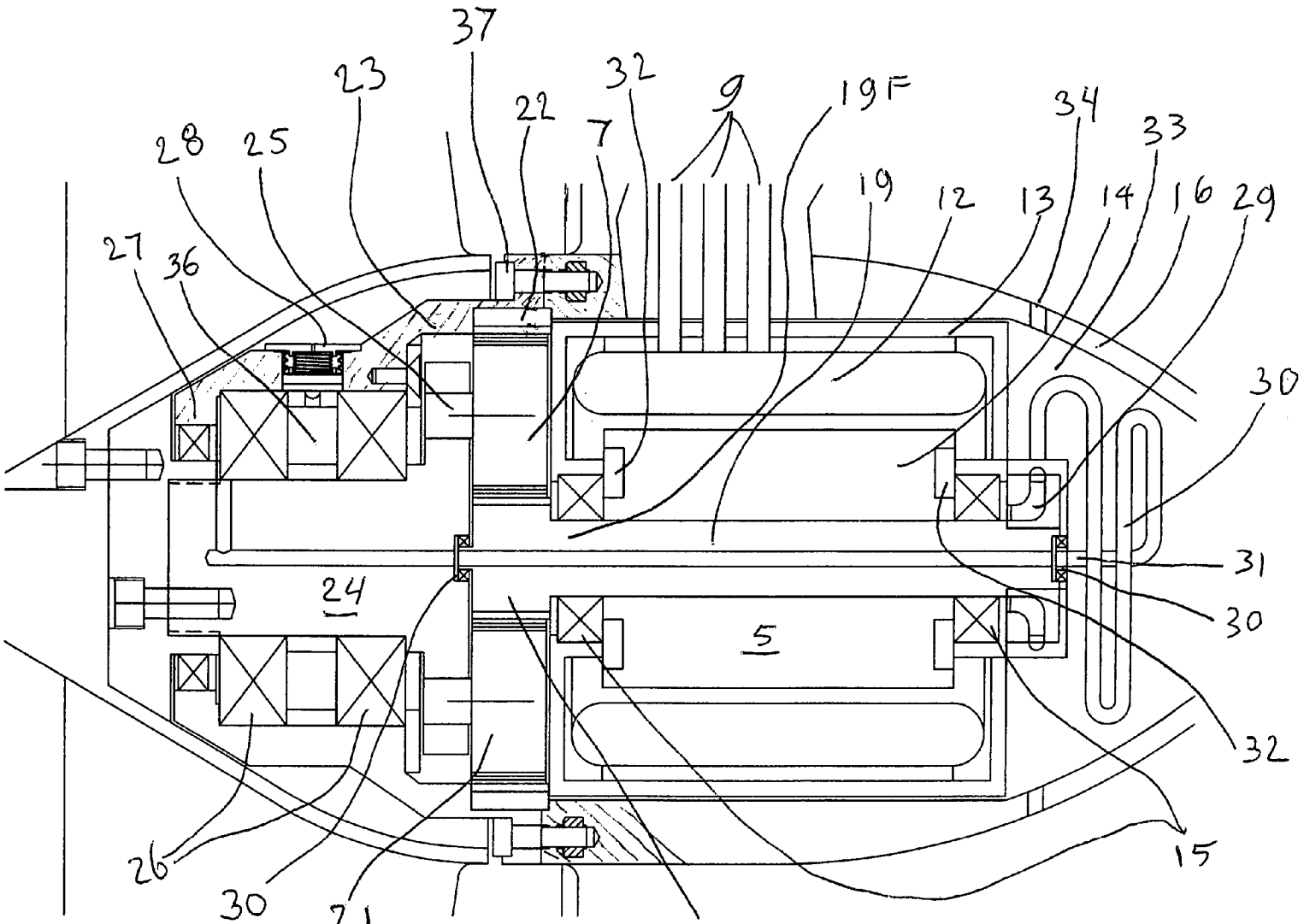
FIG. 2 is a detailed elevation section of the impeller hub and the diffusor hub of the electric waterjet of FIG. 1.

Referring to FIGS. 1 and 2, a waterjet 4 is placed in a marine vessel 1 with transom 2 and bottom 3. Waterjet 4 includes an intake duct 17, a diffusor 18 with a diffusor hub 16, and an impeller 6 driven by an electric motor 5. Motor 5 is held rigidly in diffusor hub 16 by a bearing housing 23 which, in turn are held in place by a set of bolts 37.

The motor speed is reduced to the operating speed of impeller 6 by planetary speed reducing transmission 7. Impeller 6 is supported rotatively by a bearing pack 8. The power to motor 5 comes from an electric power source such as a battery (not shown) through leads 9.

FIG. 2 shows the detail of the electric motor embodiment of FIG. 1. Motor 5 is preferably a brushless DC motor. A motor armature 12 is fixed in a motor housing 13; a rotor 14 is supported by motor bearings 15; a hollow motor shaft 19 has a sun gear 20 at a forward end 19F of shaft 19 and drives a set of planetary gears 21. A ring gear 22 is fixed in bearing housing 23. A hollow impeller shaft 24 is driven by a set of planetary gear yoke pins 25. Two pump bearings 26 support impeller shaft 24 rotatively in bearing housing 23, which in turn is supported by diffusor hub 16, fastened by bolts 37.

Power leads 9 connect to a motor controller (not shown) inside vessel 1. A oil/water seal 27 separates pump water from lubricating oil. A pressure compensator 28 maintains the oil pressure in housing 23 slightly above the ambient water pressure to prevent ingress of water into the oil. The oil performs the double duty of lubricating and cooling.

A bearing cavity 36, planetary speed reducing transmission 7, and motor cavities 32 are filled with oil. An oil pump 29 pumps oil from motor cavities 32 through an oil cooler 30, hollow motor shaft 19, and hollow impeller shaft 24. A set of swivel glands 30 prevent oil from short-circuiting the oil flow between an oil feed tube 31 and hollow shafts 19 and 24. The cooled oil is delivered to impeller bearings 26, and then flows through cavity 36 and planetary transmission 7 to motor bearings 15 and motor cavities 32, and from there back to pump 29. A diffusor hub rear cavity 33 is constantly provided with jet water for cooling through a set of cooling ports 34 at the rear tip of diffuser hub 16, as shown in FIG. 1.

Figure 3:
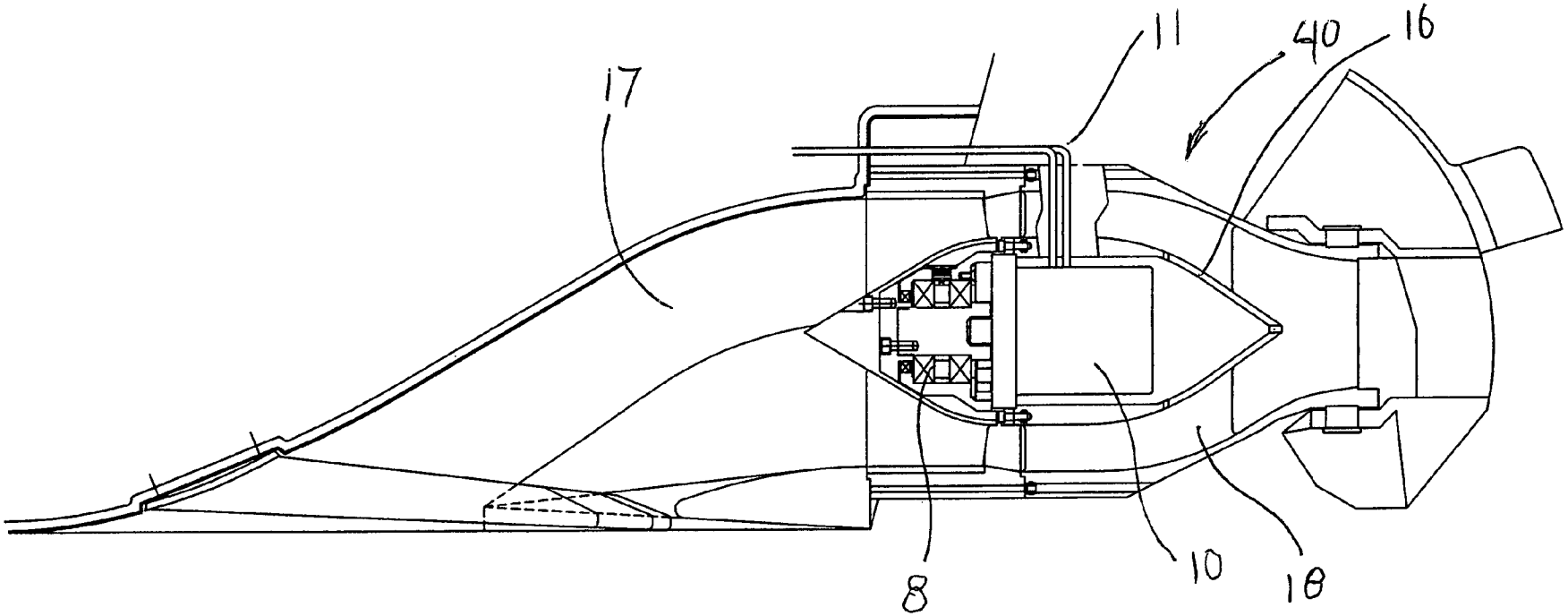
FIG. 3 is an elevation section of a hydraulic waterjet with an integrated hydraulic motor.

In the case of a hydraulically-driven waterjet propulsion system, FIG. 3 shows a hydraulic motor 10 and hydraulic fluid pressure and return tubes 11.

While the principles of this invention have been described in connection with specific embodiments, it should be understood clearly that these descriptions are made only by way of example and are not intended to limit the scope of the invention.

The invention claimed is:

1. A marine waterjet propulsion system comprising: an impeller with an impeller hub; a diffuser with a diffuser hub; at least one impeller bearing; a motor driving the impeller; and a closed-circuit lubrication and cooling system having a lubricant cooler, a circulation pump, and at least one hollow shaft forming at least one lubricant channel, the motor, the bearing(s) and the lubrication and cooling system being inside at least one of the impeller hub and the diffusor hub.

2. The marine waterjet propulsion system of claim 1 wherein the motor is an electric motor.

3. The marine waterjet propulsion system of claim 1 wherein the motor is a hydraulic motor and the hydraulic motor serves as the circulation pump.

4. The marine waterjet propulsion system of claim 1 further including a transmission, connecting the motor in a drive relationship with the impeller.

5. The marine waterjet propulsion system of claim 4 wherein the lubrication and cooling system also cools the transmission.

6. A marine waterjet propulsion system having:

an impeller with an impeller hub and at least one impeller bearing;

a diffuser with a diffuser hub;

a motor with a hollow motor shaft driving the impeller through a transmission, the motor being inside at least one of the impeller hub and the diffusor hub;

an oil circulation pump for pumping oil through the at least one bearing, the motor, and the transmission for lubrication;

an oil cooler through which oil is pumped for heat removal; and at least one hollow shaft, the at least one hollow shaft and the motor shaft being oil channels to lubricate the at least one bearing.

7. The marine waterjet propulsion system of claim 6 wherein the motor is an electric motor.

8. The marine waterjet propulsion system of claim 6 wherein the motor is a hydraulic motor.

* * * * *

UNITED STATES PATENT AND TRADEMARK OFFICE

CERTIFICATE OF CORRECTION

PATENT NO. : 7,226,324 B2
APPLICATION NO. : 10/947958
DATED : June 5, 2007
INVENTOR(S) : Roos It is certified that error appears in the above-identified patent and that said Letters Patent is hereby corrected as shown below:

In column 1, line 42, after the word “invention” delete “is.”

In column 2, line 8, delete “other embodiments” and insert --another embodiment--.

In column 2, line 39 delete “are” and insert --is--.

In column 2, line 56 delete “A” and insert --An--.

Signed and Sealed this

Sixth Day of May, 2008

JON W. DUDAS
*Director of the United States Patent and Trademark Office*